US007693479B2

(12) United States Patent
Chae

(10) Patent No.: US 7,693,479 B2
(45) Date of Patent: Apr. 6, 2010

(54) DUPLEX IMAGE FORMING APPARATUS AND DUPLEX IMAGE FORMING METHOD

(75) Inventor: Seok-heon Chae, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 618 days.

(21) Appl. No.: 11/487,393

(22) Filed: Jul. 17, 2006

(65) Prior Publication Data

US 2007/0147921 A1 Jun. 28, 2007

(30) Foreign Application Priority Data

Dec. 26, 2005 (KR) ..... 10-2005-0129731

(51) Int. Cl.
*G03G 15/00* (2006.01)

(52) U.S. Cl. ..... 399/401; 399/407; 271/291

(58) Field of Classification Search ..... 399/407, 399/306, 309; 271/291
See application file for complete search history.

(56) References Cited

U.S. PATENT DOCUMENTS 4,235,431 A * 11/1980 Abrams et al. ..... 271/10.03
6,072,585 A * 6/2000 Dutton et al. ..... 358/1.12
2003/0170048 A1* 9/2003 Ahn ..... 399/167

FOREIGN PATENT DOCUMENTS

JP 2002-296848 10/2002
JP 2003146516 A * 5/2003
JP 2004-307096 11/2004
KR 2005-742 1/2005

* cited by examiner

*Primary Examiner*—Judy Nguyen
*Assistant Examiner*—Allister Primo
(74) *Attorney, Agent, or Firm*—Staas & Halsey LLP

(57) ABSTRACT

A duplex image forming apparatus including a main body, a recording medium receiving unit disposed on one side of the main body to receive at least first and second recording media, a recording medium supplying unit to feed the first recording medium to a recording medium supplying path, an image forming unit to form an image on a first side of the fed first recording medium, an exiting and reversing unit to discharge the first recording medium formed with the image on the first side from the main body through a direct exiting path in an exiting mode, or to reverse a feeding direction of the first recording medium in a reversing mode, and a duplex feeding unit to resupply the image forming unit with the first recording medium, a rear end of the first recording medium and a front end of the second recording medium being overlapped, to feed the overlapped first and second recording media along the duplex feeding path, and to separate the first recording medium and the second recording medium on the duplex feeding path after a predetermined time.

21 Claims, 10 Drawing Sheets

DUPLEX IMAGE FORMING APPARATUS AND DUPLEX IMAGE FORMING METHOD

CROSS-REFERENCE TO RELATED APPLICATIONS

This application claims the benefit of Korean Application No. 2005-129731, filed Dec. 26, 2005, in the Korean Intellectual Property Office, the disclosure of which is incorporated herein by reference.

BACKGROUND OF THE INVENTION

1. Field of the Invention

An aspect of the present invention relates to a duplex image forming apparatus and a duplex image forming method. More particularly, an aspect of the present invention relates to a duplex image forming apparatus and a duplex image forming method, which efficiently feeds a recording medium by shortening a feeding path of the recording medium.

2. Description of the Related Art

Generally, an image forming apparatus such as a duplicator, a printer and a facsimile includes, for example, an image bearing body employed with a photoconductive drum, an electrostatic latent image forming unit, a developing unit developing the electrostatic latent image on the photoconductive drum and visualizing a developed image, a transferring unit transferring the developing agent image on the photoconductive drum to a middle transfer belt or a recording medium (i.e., paper, transparency, etc.), and a fixing unit heating and compressing the image transferred on the recording medium through the transferring unit to a high temperature and pressure to permanently fix the image on the recording medium. The image forming apparatus also generally has a duplex printing unit to consecutively print desired information on both surfaces of one sheet of recording medium (hereinafter referred to as a (or the) "recording medium").

FIG. 1 is provided to explain an operation of a conventional duplex printing image forming apparatus. As shown in FIG. 1, a pick-up roller 3 rotates and a recording medium 7 is picked up through a recording medium receiving unit 5. The picked-up recording medium 7 is fed to a recording medium supplying path 11 by a feeding roller 9.

When a registration sensor 13 senses that a front end of the fed recording medium 7 reaches a particular position, a registration roller 15 stops for a predetermined time and lines up the front end of the recording medium 7. If the registration roller 15 rotates and the recording medium 7 is fed, a feeding sensor 17 senses the front end of a first recording medium 7 and an image forming unit 20 operates after a predetermined time.

If an image is formed on one surface of the recording medium 7 through the image forming unit 20, the image transferred on the recording medium 7 through a fixing unit 19 is fixed on the recording medium 7 by fusing.

If the recording medium 7 exits a predetermined section through an exiting and reversing roller 23 formed on a direct exit path 21, a feeding direction of the recording medium 7 is reversed at a recording medium turning point S and the recording medium 7 is fed to a duplex feeding path 24.

The exiting and reversing roller 23 then rotates either counterclockwise to discharge the recording medium through the direct exiting path 21 from the image forming apparatus, or clockwise to reverse the path of the recording medium 7 at the recording medium turning point S so as feed the recording medium 7 into the duplex feeding path 24.

The recording medium 7 is then fed through duplex feeding rollers 25, 27 formed on the duplex feeding path 24 and reenters the recording medium supplying path 11, so that a duplex image may be formed on the as yet unprinted side of the recording medium 7.

Based on the structure, the pick-up roller 3, the feeding roller 9, the registration roller 15 and the image forming unit 20 are driven by a main motor 31 via a main driving system 30.

The fixing unit 19, the exiting and reversing roller 23 and the duplex transfer rollers 25, 27 are driven by an exiting and reversing driving system 50 driven by an exiting and reversing motor 51.

As is abovementioned, however, the conventional duplex image forming apparatus forms images on both surfaces of the first recording medium, and the image on one surface of a second recording medium so inconveniently that image output efficiency per minute of printing decreases.

SUMMARY OF THE INVENTION

An aspect of the present invention is to solve at least the above and/or other problems and/or disadvantages of the related art and to provide the advantages described below and/or other advantages. Accordingly, an aspect of the present invention is to provide a duplex image forming apparatus, which achieves compactness and an improved feeding velocity, by enhancing a feeding structure of a recording medium. Another aspect of the present invention is to provide a supplying method of the recording medium of the duplex image forming apparatus. Yet another aspect of the present invention is to provide a feeding method of the recording medium through the duplex image forming apparatus.

In order to achieve the above-described aspects of the present invention, there is provided a duplex image forming apparatus comprising a main body, a recording medium receiving unit disposed on one side of the main body to receive at least first and second recording media, a recording medium supplying unit to feed the recording media to a recording medium supplying path, an image forming unit to form an image on sides of the recording media, an exiting and reversing unit to discharge the first recording medium formed with the image on the first side from the main body through a direct exiting path in an exiting mode, or to reverse a feeding direction of the first recording medium in a reversing mode, and a duplex feeding unit to resupply the image forming unit with the first recording medium, a rear end of the first recording medium and a front end of the second recording medium being overlapped, to feed the overlapped first and second recording media along the duplex feeding path, and to separate the first recording medium and the second recording medium on the duplex feeding path after a predetermined time.

The duplex image forming apparatus further comprises: a main driving system to drive the recording medium supplying unit and the image forming unit; an exiting and reversing driving system to drive the exiting and reversing unit; and a duplex feeding driving system to drive the duplex feeding unit.

The duplex feeding path further comprises a duplex sensor to sense a front end of the recording medium fed through the duplex feeding path.

The duplex image forming apparatus further comprises: a sensor to sense the recording medium on at least one side of the direct exiting path and the duplex feeding path, to sense overlapping of the first recording medium and the second medium.

The recording medium supplying unit further comprises: a pickup roller to pick up the recording medium loaded in the recording medium receiving unit; a feeding roller disposed on the recording medium supplying path to feed the recording medium picked up through the pickup roller to the image forming unit; and a feeding idle roller to rotate in relation to the feeding roller.

The duplex image forming apparatus further comprises a registration unit putting at a right position the front end of the recording medium fed to the image forming unit on the recording medium supplying path between the image forming unit and the feed roller.

The exiting and reversing unit comprises: an exiting and reversing roller rotating clockwise or counter-clockwise by an exiting and reversing motor of the exiting and reversing driving system; and an exiting and reversing idle roller to rotate in relation to the exiting and reversing roller.

The exiting and reversing unit is disposed on the direct exiting path and particularly, between a recording medium turning point where the recording medium is returned, and the exiting port where the recording medium is exited externally of the main body.

The direct exiting path further comprises a fixing unit fixing the image formed on the recording medium through the image forming unit, and the fixing unit is driven by the exiting and reversing driving system.

The fixing unit stops when the exiting and reversing motor of the exiting and reversing driving system operates in the exiting mode.

The duplex feeding unit comprises at least two duplex feeding rollers operated by a duplex feeding motor forming the duplex feeding driving system, and disposed on the duplex feeding path; and a duplex feeding idle roller to rotate in relation to the duplex feeding roller corresponding to the duplex feeding roller.

The recording medium supplying path disposed between the registration unit and the image forming unit, further comprises a feeding sensor to sense the recording medium.

In order to achieve the above-described aspects of the present invention, there is provided a supplying method to operate the transfer of at least first and second recording media through a duplex image forming apparatus, comprising repeated operations of stopping the transfer of the first recording medium formed with an image on a first surface thereof at a predetermined position of a duplex feeding path defined in the apparatus, transferring a second recording medium formed with the image on one surface of thereof to the duplex feeding path such that the second recording medium overlaps with the first recording medium to form an overlapped part including a rear portion of the first recording medium and a front portion of the second recording medium, transferring the first and second recording media through the duplex feeding path such that the overlapped part is fed to an exiting part of the duplex feeding path; and stopping the transfer of the second recording medium at a predetermined position of the duplex feeding path, re-supplying the first recording medium to the image forming unit to form a duplex image, and discharging the first recording medium from the apparatus.

The stopping of the feeding of the second recording medium, further comprises supplying a third recording medium to the image forming unit to form an image formed with one surface thereof, and returning the third recording medium through the duplex feeding path.

The third recording medium is supplied a predetermined time after a rear end of the first recording medium is sensed by a sensor formed on an entry part of the image forming unit.

The stopping of the progress of the recording medium at the predetermined position of the duplex feeding path comprises sensing a front end of the first recording medium.

The sensing of the first recording medium resupplied to the image forming unit, is performed a predetermined time after the rear end of the first recording medium resupplied to the image forming unit is sensed by the sensor disposed on the exiting part of the duplex feeding path.

In order to achieve the above-described and/or other aspects of the present invention, according to another embodiment of the present invention, there is provided a duplex image forming method, comprising forming an image on a first surface of a first recording medium supplied through a recording medium supplying path by driving a main driving system, and an exiting and reversing driving system in an exiting mode, converting the exiting and reversing driving system to a reversing mode and driving a duplex feeding driving system to feed the first recording medium to a duplex feeding path, if the first recording medium formed reaches a predetermined position of a direct exiting path, stopping the first recording medium at a predetermined position of the duplex feeding path, supplying a second recording medium through a recording medium supplying path by re-driving the main driving system and the exiting and reversing driving system in the exiting mode, to form an image on one surface of the second recording medium, converting the exiting and reversing driving system to the reversing mode and supplying the second recording medium to the duplex printing path such that the second recording medium overlaps the first recording medium to form an overlapped part including a rear portion of the first recording medium and a front portion of the second recording medium, transferring the first and second recording media through the duplex feeding path such that the overlapped part is fed to an exit of the duplex feeding path by redriving the duplex feeding driving system; and stopping the duplex feeding driving system, if the overlapped part reaches the exit of the duplex feeding path such that the second recording medium is positioned at a predetermined position of the duplex feeding path.

The resupplying of the first recording medium to the image forming unit, further comprises supplying a third recording medium to the image forming unit and forming the image on one surface thereof.

The recording medium supplying unit is driven by the main driving system.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
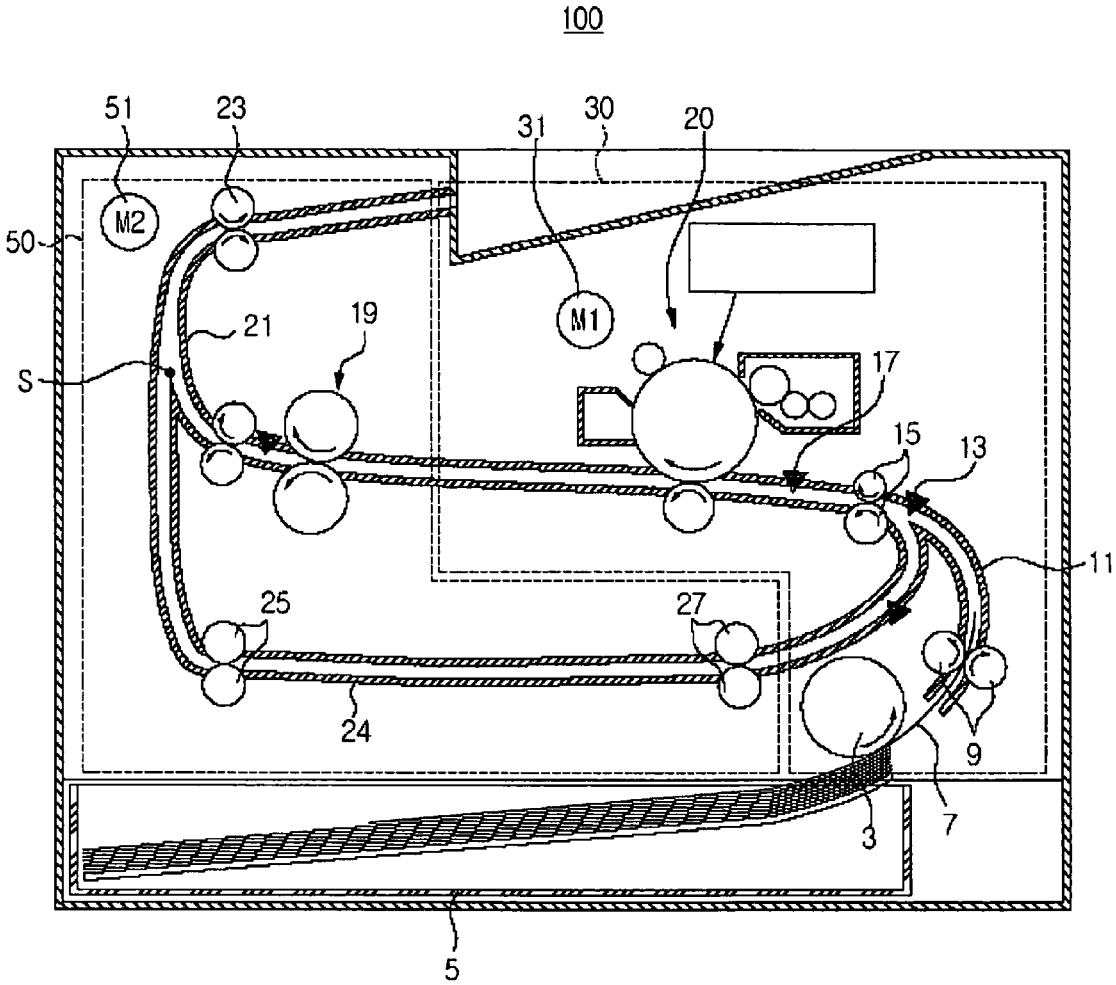
FIG. 1 (PRIOR ART)
FIG. 1 is provided to explain an operation of a duplex printing image forming apparatus in the related art.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
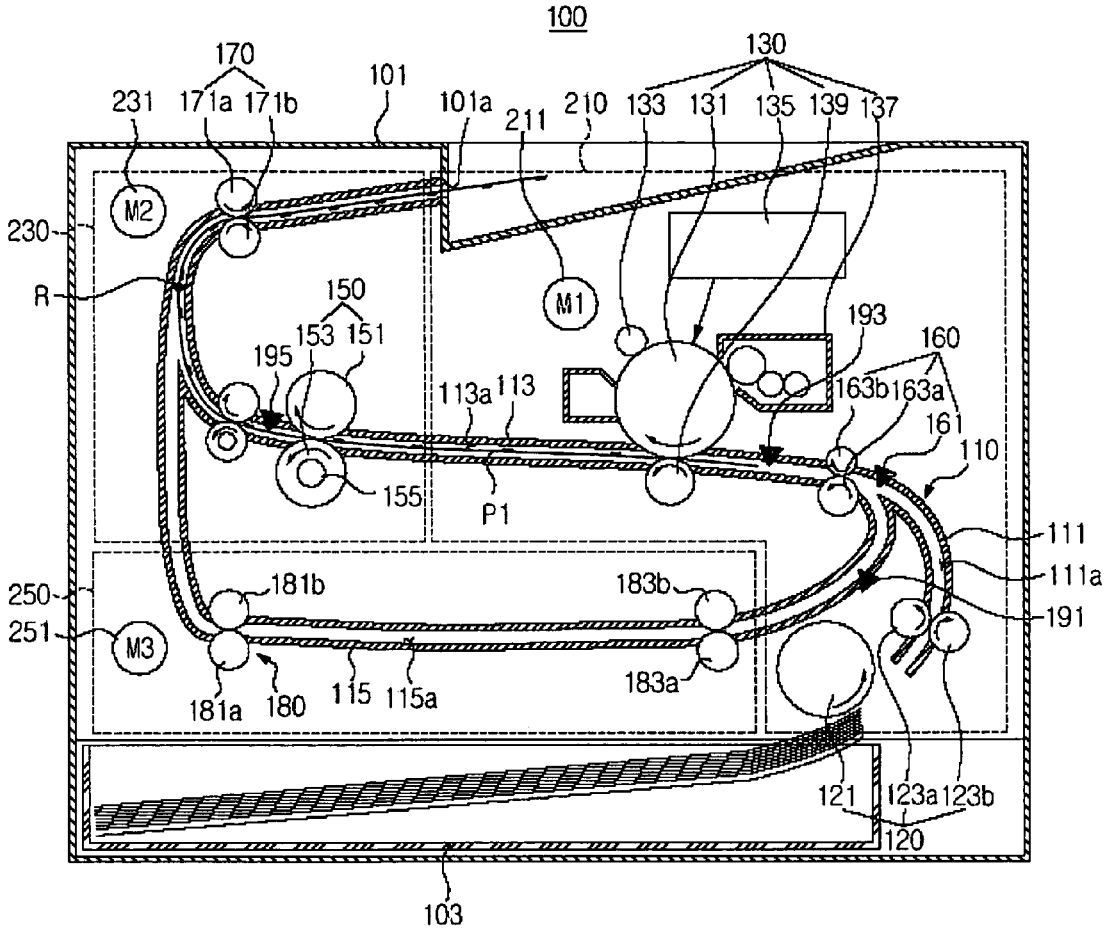
FIGS. 2 through 9 are operation state diagrams to explain operations of a duplex image forming apparatus according to an embodiment of the present invention.
Figure 3:
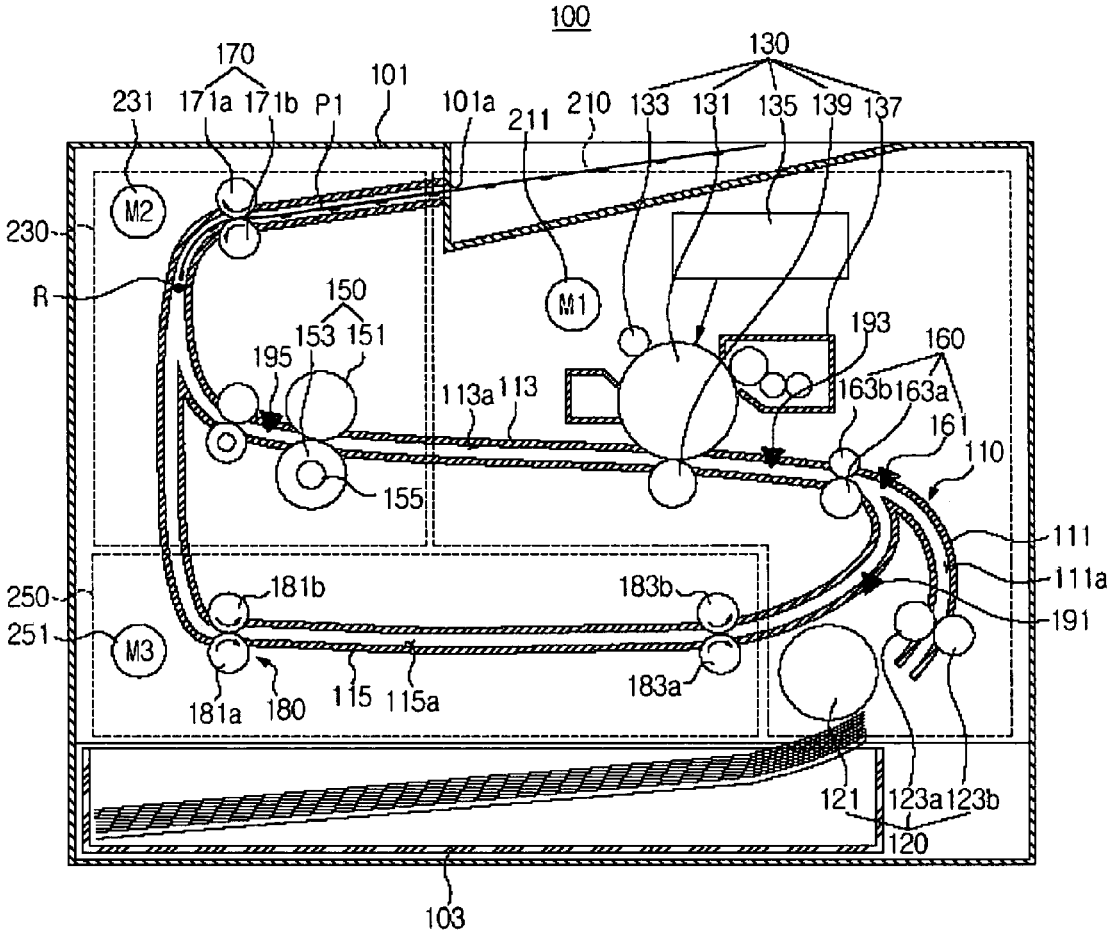
Figure 4:
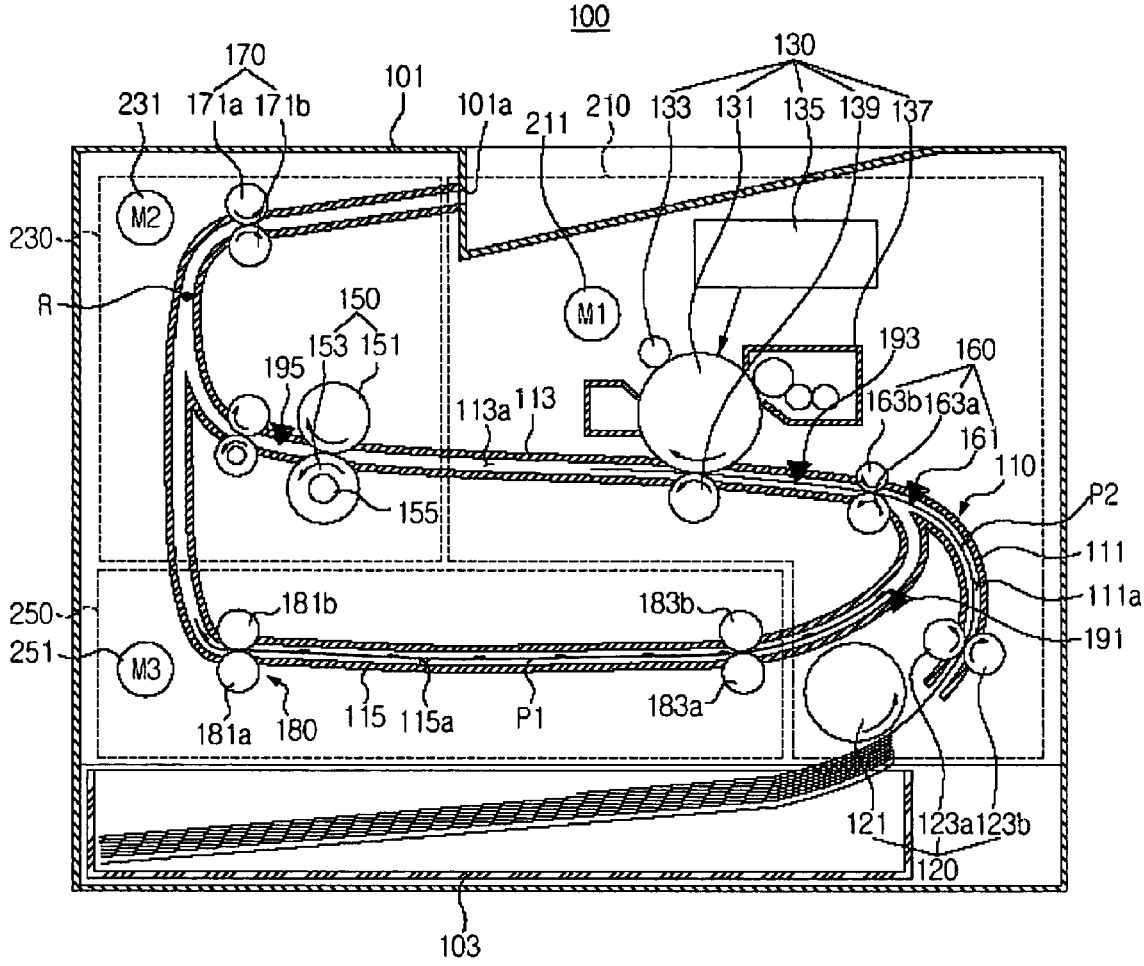
Figure 5:
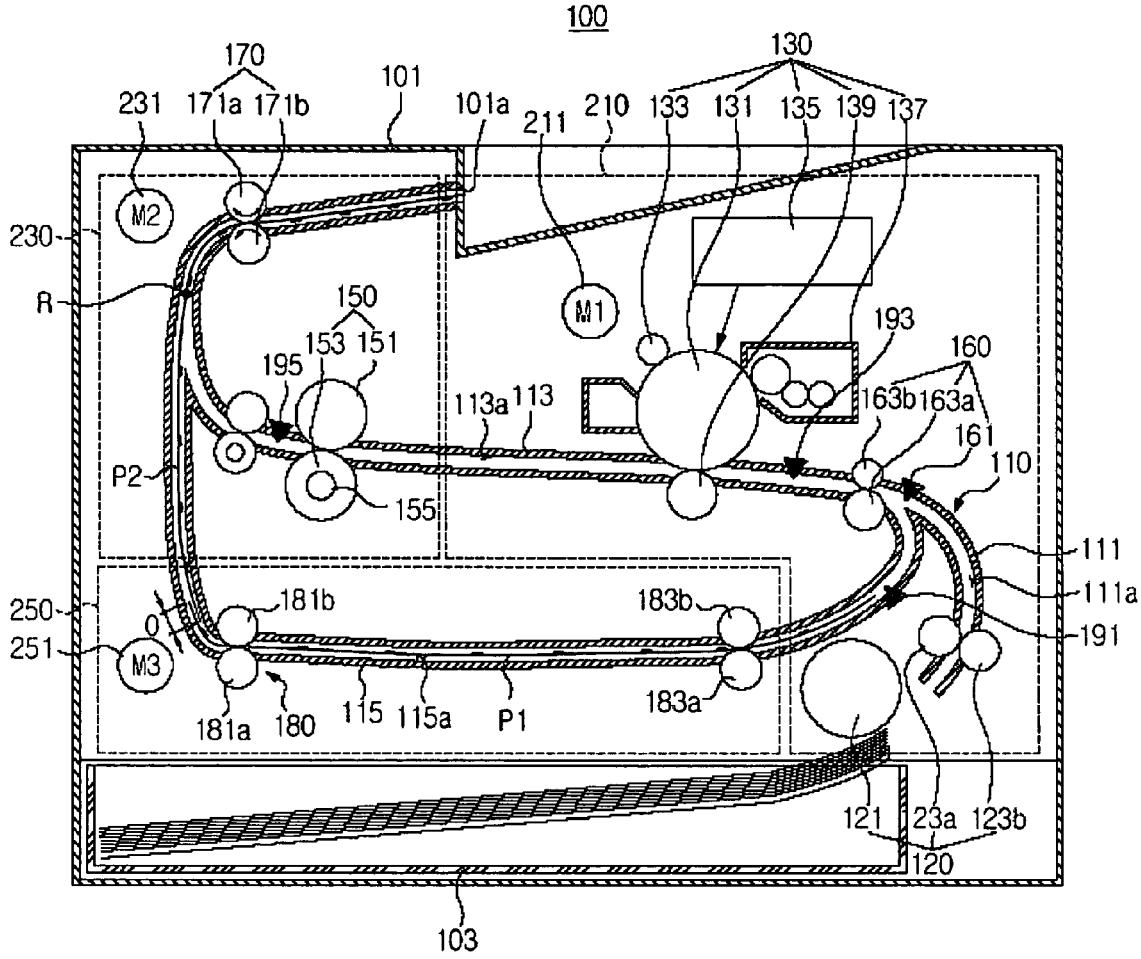
Figure 6:
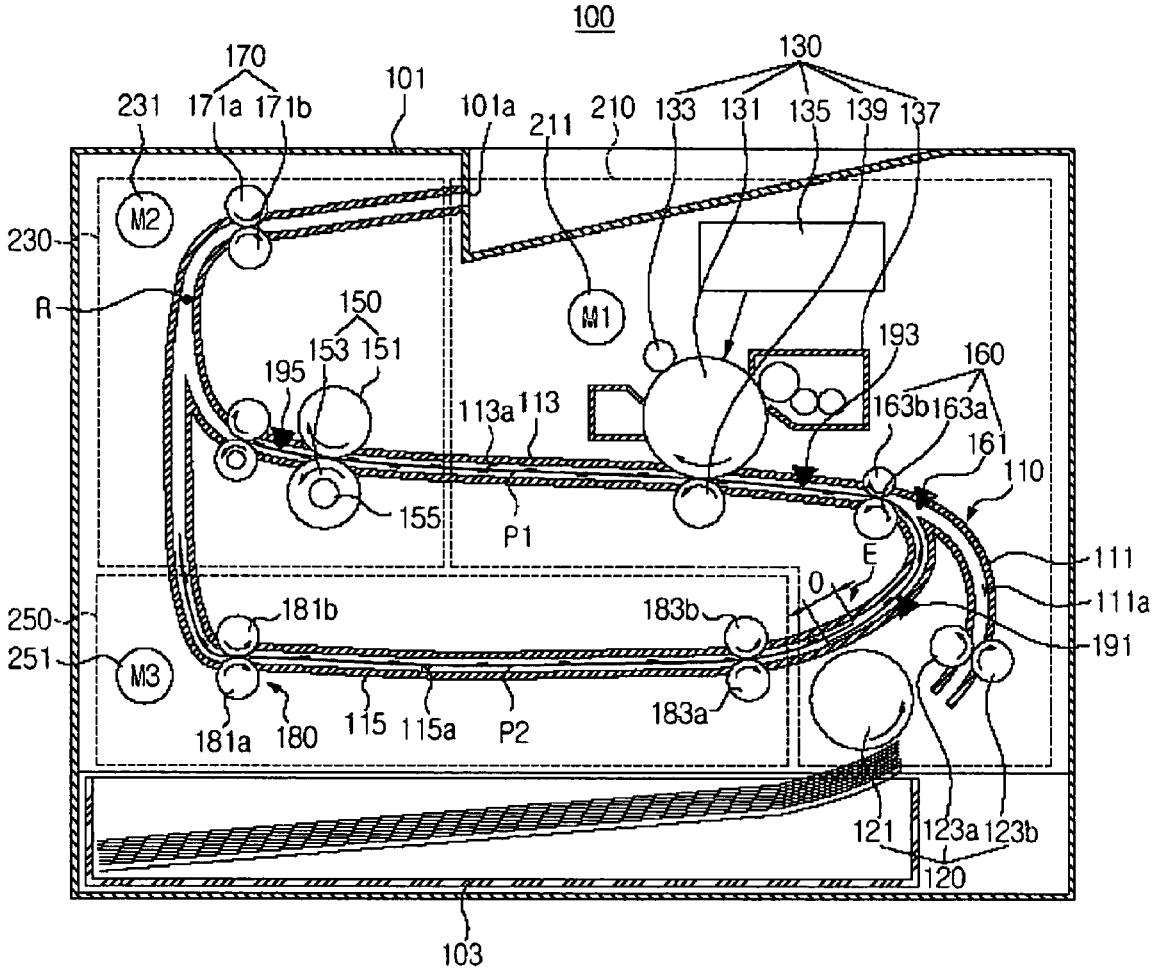
Figure 7:
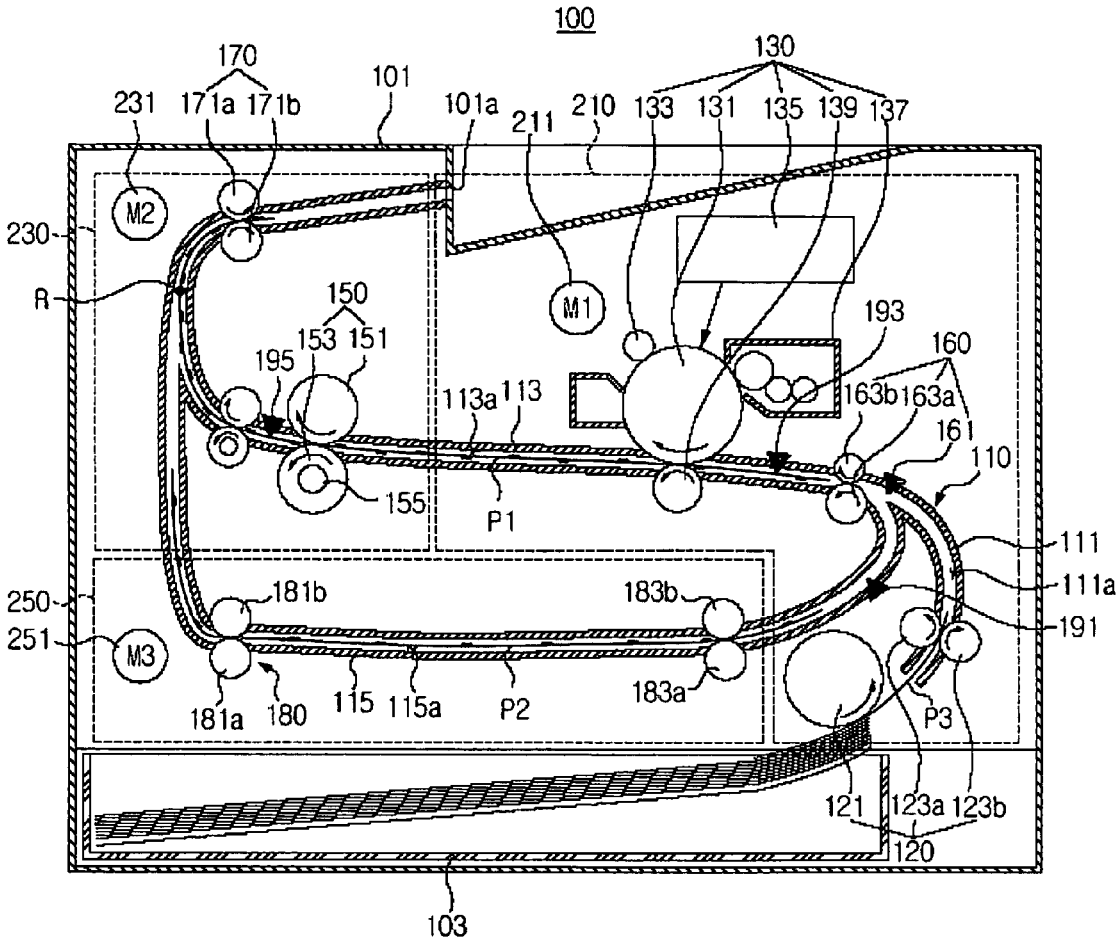

FIGS. 2 through 9 are operation state diagrams for explaining operations of a duplex image forming apparatus according to an embodiment of the present invention. As shown in FIG. 2, a duplex image forming apparatus 100 includes a main body 101, a recording medium receiving unit 103, a recording medium feeding guide unit 110, a recording medium supplying unit 120, an image forming unit 130, a fixing unit 150, an exiting and reversing unit 170 and a duplex feeding unit 180.

The recording medium feeding guide unit 110 includes a recording medium supplying path forming member 111 forming a recording medium supplying path 111*a* ranging from the recording medium receiving unit 103 to the image forming unit 130, a direct exiting path forming member 113 forming a direct exiting path 113*a* ranging from the image forming unit 130 to an exiting port 101*a* formed on one side of the main body 101, and a duplex feeding path forming member 115 forming a duplex feeding path 115*a* that meets with the recording medium supplying path 111*a* from a predetermined place of the direct exiting path 113*a*, that is, a reversion point R of a feeding direction of the recording medium (i.e., paper, transparency, or another type of medium or disk on which an image or information may be recorded).

The recording medium supplying unit 120 includes a pickup roller 121 to pick up a recording medium loaded in the recording medium receiving unit 103, and a feeding roller 123*a* and a feeding idle roller 123*b* to feed the recording medium, picked up by the pickup roller 121, to the supplying path 111*a*. A registration unit 160 is additionally formed on the recording medium supplying path 111*a* to position the front end of the recording medium supplied to the image forming unit 130.

In particular, the registration unit 160 lines up the front end of the recording medium entering into the image forming unit 130. The registration unit 160 includes a registration roller 163*a* and a registration idle roller 163*b* to temporarily stop when a registration sensor 161 senses the front end of the fed recording medium, and thereby positions the recording medium.

The image forming unit 130 forms the image on the recording medium, and includes a photoconductive drum 131, a charging roller 133 to charge a surface of the photoconductive drum 131 with a predetermined voltage, a light scanning unit 135 to scan a light on the surface of the photoconductive drum 131 charged with the predetermined voltage and to form an electrostatic latent image, a developing apparatus 137 to develop the electrostatic latent image formed on the photoconductive drum 131 with a developing agent to form a visualized image, and a transferring unit 139 to transfer the visualized image developed by the developing apparatus 137 onto the recording medium. The fixing unit 150 fixes the image formed through the image forming unit 130 by fusing the image onto the recording medium, and includes a heating roller 151 and a compressing roller 153.

Driven in an exiting mode or a reversing mode, the exiting and reversing unit 170 discharges the recording medium through the exiting port 101*a* of the main body, or feeds the recording medium having one surface printed to the duplex feeding path 115*a*. The exiting and reversing unit 170 includes an exiting and reversing roller 171*a* rotating clockwise or counter-clockwise according to the abovementioned exiting mode or reversing mode, and an exiting and reversing idle roller 171*b* rotating in relation to the exiting and reversing roller 171*a*. The exiting and reversing roller 171*a* and the exiting and reversing idle roller 171*b* are formed on the direct exiting path 113*a* and, in an embodiment of the invention, between the recording medium reversing point (R) and the exiting port 101*a*.

The duplex feeding unit 180 includes at least two duplex feeding rollers 181*a*, 183*a* formed on the duplex feeding path 115*a*, and the duplex feeding idle rollers 181*b*, 183*b* rotating in relation to the duplex feeding rollers 181*a*, 183*a*.

A duplex sensor 191 is disposed on the duplex feeding path 115*a* between the registration unit 160 and the duplex feeding roller 183*a*. The duplex sensor 191 senses the front end of the recording medium passing through the duplex feeding path 115*a*, to determine a stopping position of the recording medium.

A feeding sensor 193 is disposed on the recording medium supplying path 111*a* between the image forming unit 130 and the registration unit 160. The feeding sensor 193 senses the front end of the recording medium supplied through the recording medium supplying path 111*a*, to decide a time for the image forming unit 130 to scan light or to decide a time for a new recording medium to be supplied through the recording medium receiving unit 103.

An exiting sensor 195 may be additionally disposed on the direct exiting path 113*a* between the fixing unit 150 and the exiting and reversing roller 171*a*. The exiting sensor 195 senses a feeding state of the recording medium exited through the direct exiting path 113*a*. Based on the sensed result of the exiting sensor 195, it is possible to judge a point when a first recording medium P1 overlaps with a second recording medium P2, (refer to FIG. 5), or to judge a time when an overlapping part O between the recording medium P1 and the recording medium P2 reaches an exiting part E of the duplex feeding path 115*a*, (refer to FIG. 6). A separate sensor may be additionally formed on the duplex feeding path 115*a* to sense the overlapping part O between the recording medium P1 and the recording medium P2.

In the abovementioned structure, the recording medium supplying unit 120, the registration unit 160 and the image forming unit 130 are driven by the main driving system 210. The main driving system 210 is driven by the main motor 211 and transmits power to the recording medium supplying unit 120, the registration unit 160 and the image forming unit 130 through power transmitting members such as a gear train and a pulley (not shown).

The fixing unit 150 and the exiting and reversing unit 170 are driven by an exiting and reversing driving system 230 driven by an exiting and reversing motor 231. The fixing unit 150 uses a one-way clutch 155, to rotate when the exiting and reversing motor 231 is driven in the exiting mode only, and to stop rotating when the exiting and reversing motor 231 is driven in the reversing mode.

The duplex feeding unit 180 is driven by a duplex feeding motor 251 of the duplex feeding driving system 250.

Based on the abovementioned structure, an image forming operation will be described. FIG. 10 is a flowchart of a process for a duplex image forming according to the embodiment of the present invention. As shown in FIGS. 2 through 10, the main driving system 210 is driven and the exiting and reversing driving system 230 is driven in the exiting mode with an image being formed on one surface of the recording medium P1 supplied through the recording medium supplying path 111*a* (110).

Referring to FIGS. 3 through 10, if the recording medium P1, formed with the image on one surface thereof, reaches a predetermined position of the direct exiting path 113*a*, the exiting and reversing driving system 230 is then driven in the reversing mode and the duplex feeding driving system 250 is driven. As a result, the recording medium P1, formed with the image on one surface thereof, is fed to the duplex feeding path 115*a* (120).

Referring to FIGS. 4 to 10, if the recording medium P1 is fed to a predetermined position of the duplex feeding path 115*a*, the duplex feeding driving system 250 stops to stop the progression of the recording medium P1 at a predetermined position (130). The duplex feeding driving system 250 also stops when the front end of the recording medium P1 is sensed by the duplex sensor 191. The recording medium P2 is then supplied through the recording medium supplying path 111*a*. The main driving system 210 is driven and the exiting and reversing driving system 230 is driven at the exiting mode, to form the image on one surface of the recording medium P2 (140).

Referring to FIGS. 5 through 10, the recording medium P2, formed with the image on one surface thereof, reaches the predetermined position of the direct exiting path 113*a*. In an embodiment of the invention, the predetermined position is illustrated by the point "R" in the FIGS. The exiting and reversing driving system 230 is then converted into the reversing mode and causes an overlap of a part of the recording medium P1 and the recording medium P2 (150). Here, it is possible to calculate the size of the overlapping part O between the recording medium P1 and the recording medium P2, through the exiting sensor 195. For example, it is possible to judge an overlapping state between the recording medium P1 and the recording medium P2 by counting from a time when a rear end of the recording medium P1 is sensed and a time when the front end of the recording medium P2 is sensed.

Referring to FIGS. 6 through 10, the duplex feeding driving system 250 is redriven to feed the recording medium P1 and the recording medium P2 with the overlapping part of the recording media P1 and P2 (i.e., "O") maintained towards an exiting part E of the duplex feeding path 115*a* (160). The main driving system 210 and the exiting and reversing driving system 230 are driven together to perform duplex-printing of the recording medium P1. The exiting and reversing driving system 230 is driven at the exiting mode.

Referring to FIGS. 7 through 10, if the overlapping part O is fed to the portion of the duplex feeding path 115*a* labeled E (see FIG. 6), the duplex feeding driving system 250 stops (170). If the rear end of the recording medium P1, resupplied to the image forming unit 130, is sensed through the feeding sensor 193, after a predetermined time, the pickup roller 121 rotates to supply a third recording medium P3 through the recording medium receiving unit 103 (171). The point when the overlapping part O reaches the portion E of the duplex feeding path 115*a* is obtained by counting a predetermined time passing from the point overlapping between the recording medium P1 and the recording medium P2.

Figure 8:
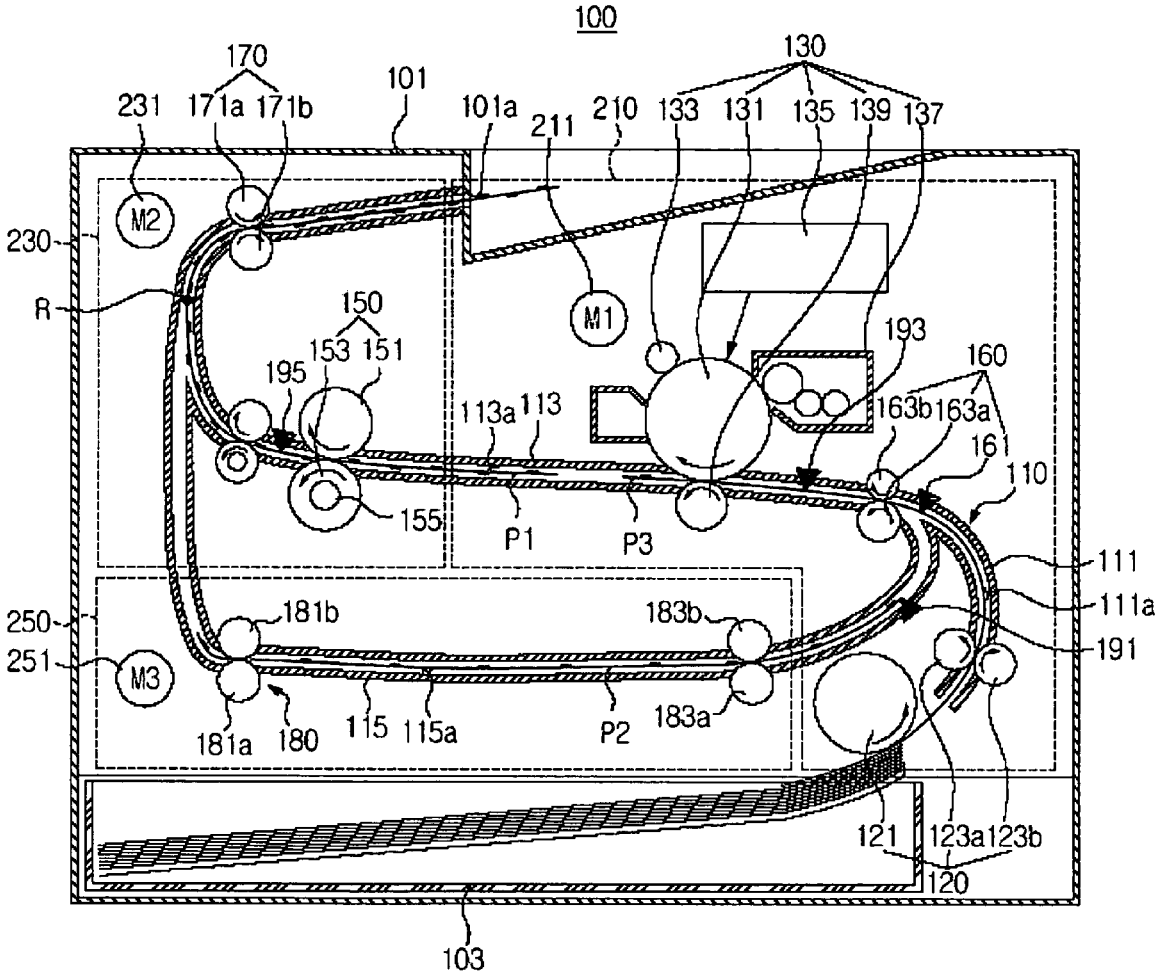

Referring to FIGS. 8 and 10, if the recording medium P2 reaches the exit of the duplex feeding path 115*a*, the duplex feeding driving system 250, having been driven for a predetermined time, is stopped. Thus, the recording medium P2 is stopped at a predetermined position of the duplex feeding path 115*a* (180). In more detail, the duplex sensor 191 senses the rear end of the recording medium P1, and, if a predetermined time passes from the sensed point in time, the duplex feeding driving system 250 is driven for a predetermined time and stopped. If the front end of the recording medium P2 is sensed by the duplex sensor 191, the duplex feeding driving system 250 stops driving and thereby stops the progress of the recording medium P2 at the predetermined position of the duplex feeding path 115*a*.

Figure 9:
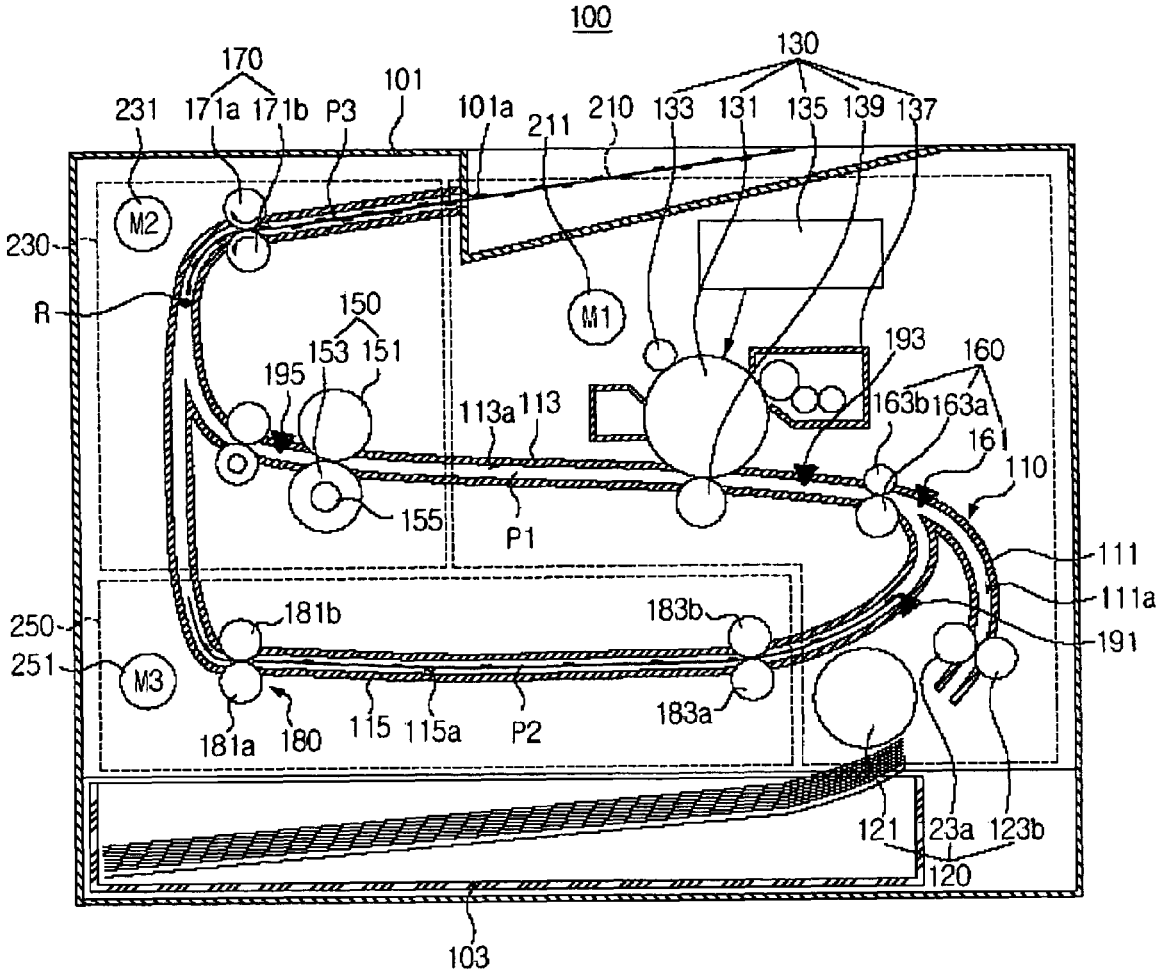
Figure 10:
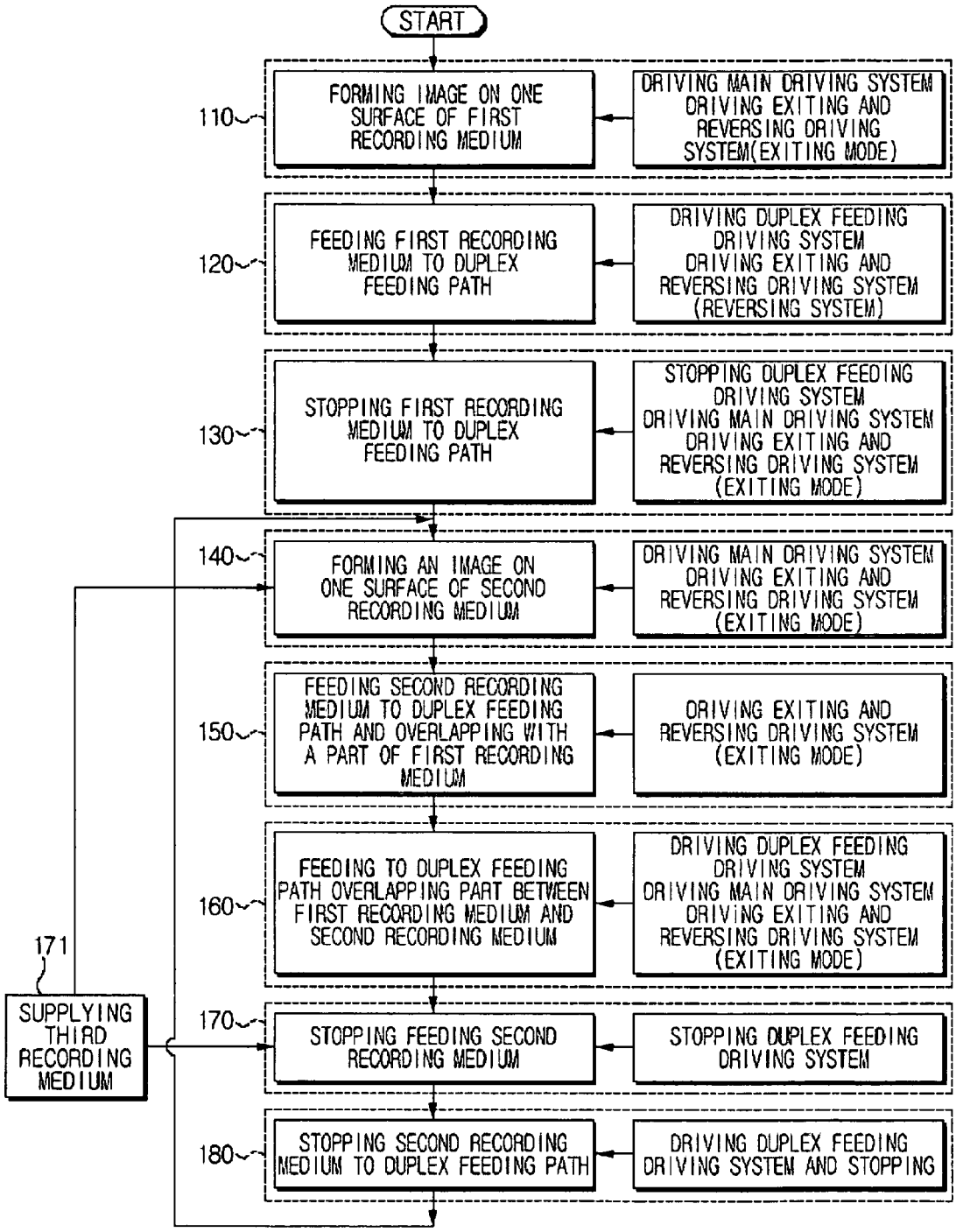
FIG. 10 is a flowchart of a process for a duplex image forming according to the embodiment shown in FIGS. 2-9.

Referring to FIGS. 9 through 10, the recording medium P3 is printed on one surface thereof and transferred to the duplex feeding path 115*a* in a similar manner as described above with respect to recording media P1 and P2, and overlaps with a part of the recording medium P2 having been stopped in the duplex feeding path 115*a*. Here, the duplex printing operations for the overlapped recording media P2 and P3 are the same as the duplex printing operations of operation 150 where the recording media P1 and P2 overlap. Similarly, operations 160, 170 and 180 are also repeated.

As is abovementioned, according to an embodiment of the present invention, it is possible to shorten a feeding path of the recording medium, to minimize a size of a product. Recording medium feeding is thus sped up by making a part of the recording medium overlap through the duplex feeding path and separating them afterwards.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A duplex image forming apparatus comprising:

a main body;

a recording medium receiving unit disposed on one side of the main body to receive at least first and second recording media;

a recording medium supplying unit to feed the recording media to a recording medium supplying path;

an image forming unit to form an image on sides of the recording media;

an exiting and reversing unit to selectively discharge the first recording medium formed with the image from the main body through a direct exiting path in an exiting mode, and/or to reverse a feeding direction of the first recording medium in a reversing mode;

a duplex feeding unit to resupply the image forming unit with the first recording medium;

a duplex feeding driving system to drive the duplex feeding unit such that a rear end of the first recording medium and a front end of the second recording medium are overlapped, to drive the duplex feeding unit to feed the overlapped first and second recording media along a duplex feeding path, and to drive the duplex feeding unit to separate the first recording medium and the second recording medium on the duplex feeding path after a predetermined time;

a main driving system to drive the recording medium supplying unit to feed the recording media to a recording medium supplying path and to drive the image forming unit to form the image on the sides of the recording media; and an exiting and reversing driving system to drive the exiting and reversing unit to selectively discharge the first recording medium formed with the image from the main body through the direct exiting path in the exiting mode, and/or to reverse the feeding direction of the first recording medium in the reversing mode.

2. The duplex image forming apparatus of claim 1, wherein the duplex feeding path further comprises a duplex sensor to sense a front end of the recording medium fed through the duplex feeding path.

3. The duplex image forming apparatus of claim 1, further comprising a sensor to sense the recording medium on at least one side of the direct exiting path and the duplex feeding path, and to sense an overlapping condition of the first recording medium and the second medium.

4. The duplex image forming apparatus of claim 1, wherein the recording medium supplying unit comprises:

a pickup roller to sequentially pick up the recording media loaded in the recording medium receiving unit;

a feeding roller disposed on the recording medium supplying path to feed each recording medium picked up through the pickup roller to the image forming unit; and a feeding idle roller to roll in relation to the feeding roller.

5. The duplex image forming apparatus of claim 4, further comprising a registration unit to position the front end of the recording medium fed to the image forming unit on the recording medium supplying path between the image forming unit and the feed roller.

6. The duplex image forming apparatus of claim 1, wherein the exiting and reversing driving system comprises an exiting and reversing motor, and wherein the exiting and reversing unit comprises:

an exiting and reversing roller to rotate clockwise or counter-clockwise, the exiting and reversing roller being driven by the exiting and reversing motor; and an exiting and reversing idle roller to rotate in relation to the exiting and reversing roller.

7. The duplex image forming apparatus of claim 6, wherein the exiting and reversing unit is disposed on the direct exiting path between a recording medium turning point where the recording medium is returned, and the exiting port where the recording medium is discharged from the main body.

8. The duplex image forming apparatus of claim 1, wherein the direct exiting path further comprises a fixing unit to fix the image formed on the recording medium through the image forming unit, and wherein the fixing unit is driven by the exiting and reversing driving system.

9. The duplex image forming apparatus of claim 8, wherein the fixing unit stops when the exiting and reversing motor of the exiting and reversing driving system operates in the exiting mode.

10. The duplex image forming apparatus of claim 1, wherein the duplex feeding unit comprises:

at least two duplex feeding rollers, which are operated by a duplex feeding motor forming the duplex feeding driving system, and which are disposed on the duplex feeding path; and a duplex feeding idle roller, corresponding to the duplex feeding roller, to rotate in relation to the duplex feeding roller.

11. The duplex image forming apparatus of claim 5, wherein the recording medium supplying path disposed between the registration unit and the image forming unit further comprises a feeding sensor to sense positions of the first and second recording medium.

12. A supplying method to operate the transfer of at least first and second recording media through a duplex image forming apparatus, comprising repeated operations of:

stopping the transfer of the first recording medium formed with an image on a first surface thereof at a predetermined position of a duplex feeding path defined in the apparatus;

transferring a second recording medium formed with the image on one surface of thereof to the duplex feeding path such that the second recording medium overlaps with the first recording medium to form an overlapped part including a rear portion of the first recording medium and a front portion of the second recording medium;

transferring the first and second recording media through the duplex feeding path such that the overlapped part is fed to an exiting part of the duplex feeding path; and stopping the transfer of the second recording medium at a predetermined position of the duplex feeding path, re-supplying the first recording medium to the image forming unit to form a duplex image, and discharging the first recording medium from the apparatus.

13. The supplying unit of claim 12, wherein the stopping of the transfer of the second recording medium, comprises supplying a third recording medium to the image forming unit to form an image on one surface thereof, and transferring the third recording medium through the duplex feeding path.

14. The supplying unit of claim 13, further comprising a sensor to sense a position of the first recording medium formed on an entry part of the image forming unit, wherein the third recording medium is supplied a predetermined time after a rear end of the first recording medium is sensed by the sensor.

15. The supplying unit of claim 12, further comprising a duplex sensor formed at an exit of the duplex feeding path, wherein, in the stopping of the first recording medium at the predetermined position of the duplex feeding path, the feeding of the first recording medium stops, if a front end of the first recording medium is sensed by the duplex sensor.

16. The supplying unit of claim 12, further comprising a sensor disposed at an exit of the duplex feeding path, wherein the sensing of the first recording medium being re-supplied to the image forming unit is performed a predetermined time after the rear end of the first recording medium is sensed by the sensor.

17. A duplex image forming method, comprising:

forming an image on a first surface of a first recording medium supplied through a recording medium supplying path by driving a main driving system, and an exiting and reversing driving system in an exiting mode;

converting the exiting and reversing driving system to a reversing mode and driving a duplex feeding driving system to feed the first recording medium to a duplex feeding path, if the first recording medium formed reaches a predetermined position of a direct exiting path;

stopping the first recording medium at a predetermined position of the duplex feeding path;

supplying a second recording medium through a recording medium supplying path by re-driving the main driving system and the exiting and reversing driving system in the exiting mode, to form an image on one surface of the second recording medium;

converting the exiting and reversing driving system to the reversing mode and supplying the second recording medium to the duplex printing path such that the second recording medium overlaps the first recording medium to form an overlapped part including a rear portion of the first recording medium and a front portion of the second recording medium;

transferring the first and second recording media through the duplex feeding path such that the overlapped part is fed to an exit of the duplex feeding path by redriving the duplex feeding driving system; and stopping the duplex feeding driving system, if the overlapped part reaches the exit of the duplex feeding path such that the second recording medium is positioned at a predetermined position of the duplex feeding path.

18. The duplex image forming method of claim 17, wherein the resupplying of the first recording medium to the image forming unit, further comprises supplying a third recording medium to the image forming unit and forming the image on one surface thereof.

19. The duplex image forming method of claim 18, wherein the recording medium supplying unit is driven by the main driving system.

20. A method of operating an image forming apparatus in a double sided mode, the apparatus including a duplex feeding path to allow for either single or double sided printing and an image forming unit, the method comprising:

printing an image on a first side of a first recording medium in the image forming unit;

transferring the first recording medium to the duplex printing path and stopping the progression of the first recording medium at a predetermined position therein;

printing the image on a first side of the second recording medium in the image forming unit;

transferring the second recording medium to the duplex printing path such that the second recording medium partially overlaps the first recording medium; and transferring the first and second recording media through the duplex printing path in the overlapped condition such that the first recording medium is returned to the image forming unit, the second recording medium being stopped at the predetermined position.

21. The method according to claim 20, wherein the method is repeated with the second recording medium and a third recording medium.

* * * * *

UNITED STATES PATENT AND TRADEMARK OFFICE

CERTIFICATE OF CORRECTION

PATENT NO. : 7,693,479 B2
APPLICATION NO. : 11/487393
DATED : April 6, 2010
INVENTOR(S) : Seok-heon Chae It is certified that error appears in the above-identified patent and that said Letters Patent is hereby corrected as shown below:

Column 10, Line 20, delete “unit” and insert --method-- therefor.

Column 10, Line 25, delete “unit” and insert --method-- therefor.

Column 10, Line 31, delete “unit” and insert --method-- therefor.

Column 10, Line 37, delete “unit” and insert --method-- therefor.

Signed and Sealed this
Seventh Day of February, 2012

David J. Kappos

David J. Kappos
*Director of the United States Patent and Trademark Office*